US007724153B2

(12) United States Patent
Oppelt

(10) Patent No.: US 7,724,153 B2
(45) Date of Patent: May 25, 2010

(54) POWER SUPPLY BASE FOR AN ALARM DEVICE

(75) Inventor: Ulrich Oppelt, Zorneding (DE)

(73) Assignee: Robert Bosch GmbH, Stuttgart (DE)

( * ) Notice: Subject to any disclaimer, the term of this patent is extended or adjusted under 35 U.S.C. 154(b) by 252 days.

(21) Appl. No.: 11/950,784

(22) Filed: Dec. 5, 2007

(65) Prior Publication Data

US 2008/0211658 A1 Sep. 4, 2008

(30) Foreign Application Priority Data

Mar. 2, 2007 (DE) ..... 10 2007 010 190

(51) Int. Cl.
*G08B 23/00* (2006.01)

(52) U.S. Cl. ..... 340/693.1; 340/3.62; 340/286.05

(58) Field of Classification Search ... 340/693.1–691.7, 340/693.4–693.7, 3.42, 3.62, 3.8, 5.3, 14.69, 340/14.68, 14.62, 286.05, 815.45
See application file for complete search history.

(56) References Cited

U.S. PATENT DOCUMENTS 3,654,518 A * 4/1972 Phelps et al. ..... 361/101
4,316,134 A * 2/1982 Balan et al. ..... 322/99
5,726,851 A * 3/1998 Knapp ..... 361/104
5,959,532 A * 9/1999 Fujiuchi et al. ..... 340/572.3
6,144,445 A * 11/2000 Nilssen ..... 315/209 R
7,129,759 B2 * 10/2006 Fukami ..... 327/110
2002/0075048 A1 * 6/2002 Miyamoto ..... 327/158
2003/0112570 A1 * 6/2003 Koida ..... 361/93.9

FOREIGN PATENT DOCUMENTS

WO 97/05586 3/1997

* cited by examiner

*Primary Examiner*—Daniel Previl
(74) *Attorney, Agent, or Firm*—Michael J. Striker

(57) ABSTRACT

A power supply base for an alarm device contains at least one pair, comprising a first terminal for an incoming power supply line and a second terminal for an outgoing power supply line, and a switch element for initial electrical connection of the respective first terminal to the second terminal of the at least one pair. The switch element has an actuating device for switching the switch element into a nonconducting state in response to an insertion of an alarm device into the power supply base.

8 Claims, 3 Drawing Sheets

POWER SUPPLY BASE FOR AN ALARM DEVICE

CROSS-REFERENCE TO A RELATED APPLICATION

The invention described and claimed hereinbelow is also described in German Patent Application DE 102007010190.4 filed on Mar. 2, 2007. This German Patent Application, whose subject matter is incorporated here by reference, provides the basis for a claim of priority of invention under 35 U.S.C. 119(a)-(d).

BACKGROUND OF THE INVENTION

The present invention relates to a power supply base for an alarm device, in particular a fire alarm or smoke alarm.

The present invention also relates to a method for setting up the power supply base of the invention.

Below, fundamental problems that the invention is response to are described, based on power supply bases for fire alarms, but without limiting the subject to power supply bases of that kind.

A fire alarm is known from International Patent Disclosure WO 97/05586, among other sources. These fire alarms typically comprise two parts, namely a power supply base and a fire sensor. The power supply base can be mounted on the ceiling and is connected by power supply lines to a fire-detection-system control unit. The fire sensor is inserted into the power supply base by technicians.

Typically, many fire alarms, in a series circuit or serial topology, are connected to a fire-detection-system control unit 1 (FIG. 1). For safety reasons, it is necessary that the fire-detection-system control unit 1 be able to tell whether all the fire sensors 2 are functional and in particular have been inserted into the associated power supply bases 3. This requirement is met by providing that each power supply base 3 internally interrupts the power supply line 4. Not until a fire sensor 2 is inserted does it connect to internal terminals 5, 6 of the power supply base 3. The interruption in the power supply line is thus bridged by the fire sensors 2. If one or more fire sensors 2 is missing, the power supply line 4 is interrupted. This interruption can be detected, for instance by means of a resting current measurement in the central warning system 1. Typically, a termination resistor 7 connects the power supply line 4 to a return line 8.

The resting current measurements and perfect function of the alarms, however, function only with correct wiring of the power supply bases 3 beforehand. It is therefore desirable to be able to check the correctness of the wiring even before any alarms have been inserted. This reduces the effort and expense for looking for mistakes in the event of incorrect wiring in particular.

SUMMARY OF THE INVENTION

Accordingly, it is an object of the present invention to provide a power supply base for an alarm device which is a further improvement of the existing basis.

The power supply base of the invention makes simple detection of connection errors of the power supply base possible. In particular, it makes it possible to detect connection errors without inserted alarm devices that bridge internal terminals. The method of the invention having the characteristics of claims 8 and 9 make use of the power supply bases of the invention for the proper installation of the same.

The power supply base of the invention for an alarm device includes at least one pair, comprising a first terminal for an incoming power supply line and a second terminal for an outgoing power supply line, and a switch element for initial electrical connection of the respective first terminal to the second terminal of the at least one pair; the switch element has an actuating device for switching the switch element to a nonconducting state in response to an insertion of an alarm device into the power supply base.

In a power supply base that is new from the factory, or a newly installed power supply base, the switch element connected the first terminal and the second terminal inside the power supply base. As a result, the incoming power supply line is electrically connected to the outgoing power supply line. In a series circuit or ring circuit of a plurality of power supply bases, a continuous power supply line is the result. Interruptions in the power supply line or defective contacts at connection points can thus readily be detected by testing the resistance of the power supply line.

Once an alarm device has first been inserted into the power supply base, the switch element is actuated in such a way that it remains in a nonconducting state. If a warning sensor is removed, the warning system can detect the interrupted power supply line and issue an error report.

In one embodiment, the switch element has a locking device for keeping the switch element in the nonconducting state. This assures that after first being actuated, the power supply line is no longer bridged by the switch element. Only by manual intervention can the switch element be released from the locking device.

In an especially preferred embodiment, the switch element has an internal resistor that is greater than the line resistance of the power supply lines. By measuring the resistance of the power supply bases connected in series or in a ring, it becomes possible to tell how many power supply bases have been properly installed. This expands the process of monitoring of the installation of the power supply bases. Moreover, it is possible for a central warning system to distinguish whether switch element is connecting the power supply line, or whether a properly inserted alarm device, with a negligibly slight resistance, has been properly inserted into the power supply base. In the first case, a warning system that was in operation would emit a warning that the alarm device might not have been properly inserted.

A diode can be connected in parallel in the blocking direction to the switch element or the internal resistor of the switch element. The blocking direction is in terms of the properly provided flow of current in the power supply line. If power supply bases are connected with incorrect polarization, they can be identified or at least detected in this way.

A further embodiment provides that a communications device for outputting an unambiguous identification of the power supply base is provided; the communications device is coupled in a switchable way by means of the switch device to the first terminal and to the second terminal. The communications device makes communication with a central warning system possible. The central warning system, based on the number and optionally on the unambiguous identifications of the power supply bases, can determine whether all the power supply bases provided have been properly connected. Once an alarm device has been inserted for the first time, the communications device of the power supply base is disconnected from the power supply lines.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 2:
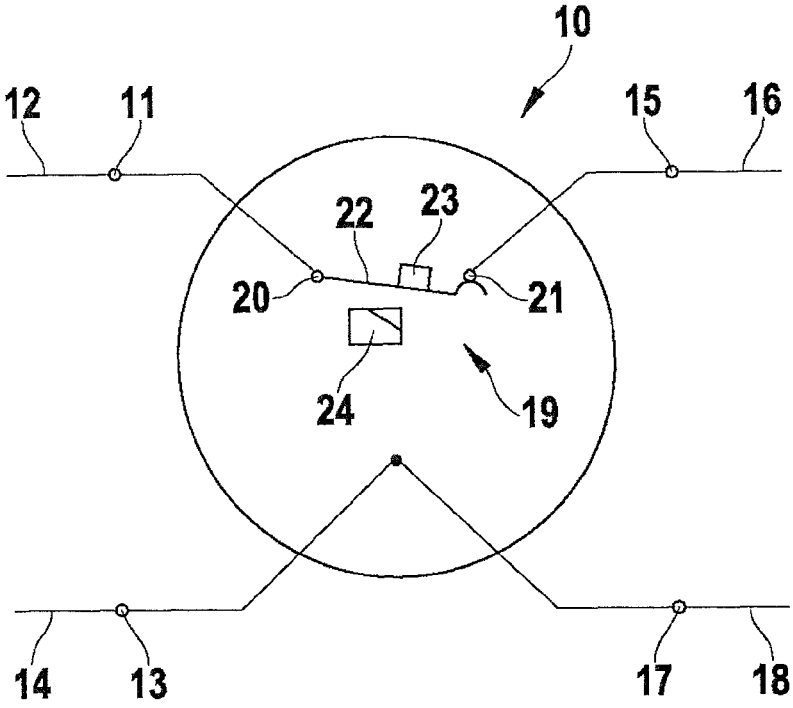
FIG. 2 shows a first embodiment of a power supply base according to the invention.

FIG. 2 schematically shows a first embodiment of a power supply base 10. On the input side, the power supply base 10 has an external terminal 11 for an incoming power supply line 12. Also on the input side, a further external terminal 13 for a return line 14 is provided. On the output side, an external terminal 15 for an outgoing power supply line is located on the power supply base 10. A further external terminal 17 connects the outgoing return line 18 to the power supply base 10. In the embodiment shown, the incoming return line 14 is permanently connected to the outgoing return line 18 internally in the power supply base 10. The two return lines 14, 18 can be connected together to one external contact.

The incoming power supply line 12 and the outgoing power supply line 16 are electrically connected to one another inside the power supply base 10 only via a switch element 19. In the first embodiment, the switch element for example comprises a first terminal 20, which is connected to the incoming power supply line 12, and a second terminal 21, which is connected to the outgoing power supply line 16. A spring contact 22 can connect the first terminal 20 to the second terminal 21 electrically conductively. In a state of the power supply base 10 as shipped, the switch element 19 is in the conducting state, shown in FIG. 2.

On the spring contact 22, an actuating device 23 is provided, for instance in the form of a lug, tab, or the like, which is engaged by a corresponding counterpart element of the alarm device. When the alarm device is inserted, the engaging element of the alarm device pushes the spring contact 22 as far as a locking device 24. The locking device 24 is set up in such a way that the spring contact 22 is firmly held even if the alarm device is later removed again. Optionally, the locking device 24 is embodied in such a way that manually releasing the spring contact 22 from the locking device 24 is possible.

The actuating device may also be a simple surface engaged by a lug, tab, and so forth of the alarm device that is to be screwed in or inserted, in order to push the spring contact 22 into the locking device 24.

The actuating device with the spring contact thus forms a switch on which the alarm device exerts a mechanical force in order to actuate the switch.

Figure 1:
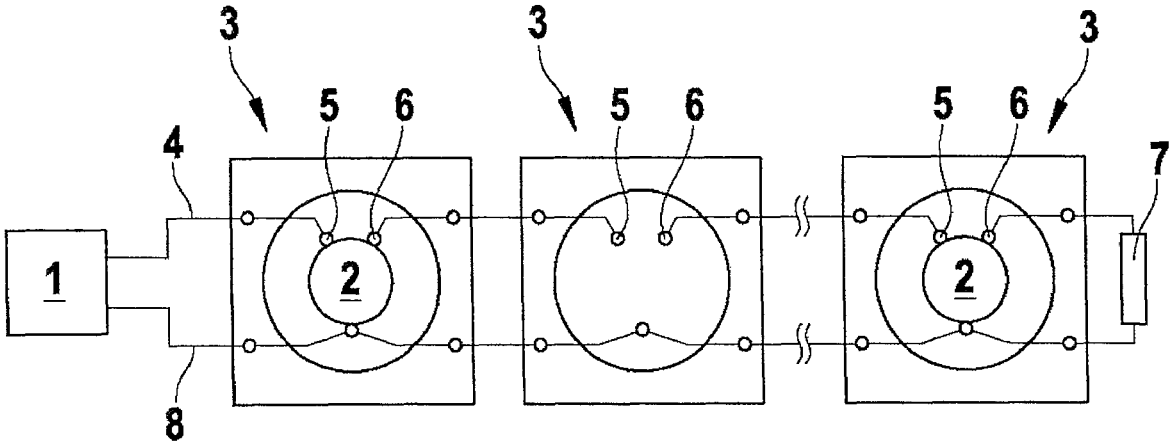
FIG. 1 shows a series circuit of a plurality of power supply bases.

A plurality of power supply bases shown in FIG. 2 can be connected to one another in a way analogous to the series circuit shown in FIG. 1. A ring circuit of the power supply bases 10 to a central warning system 1 is equally possible. Once the power supply bases 10 have been installed and connected to one another in series or in a ring via power supply lines 12, 16 and return lines 14, 18, the resistance of the series-connected power supply lines 12, 16 and power supply bases 10 is determined. If the resistance is above a predetermined threshold value, a warning that indicates improper wiring is emitted. Instead of a resistance measurement, a simple continuity check of the power supply line can be performed. Checking the resistance or continuous conductivity can be done automatically by the central warning system or manually by an installer. Not until the proper installation and wiring of the power supply bases 10 has been assured are the warning elements, such as fire alarms, smoke alarms, gas alarms, and so forth, inserted into the power supply bases.

Figure 3:
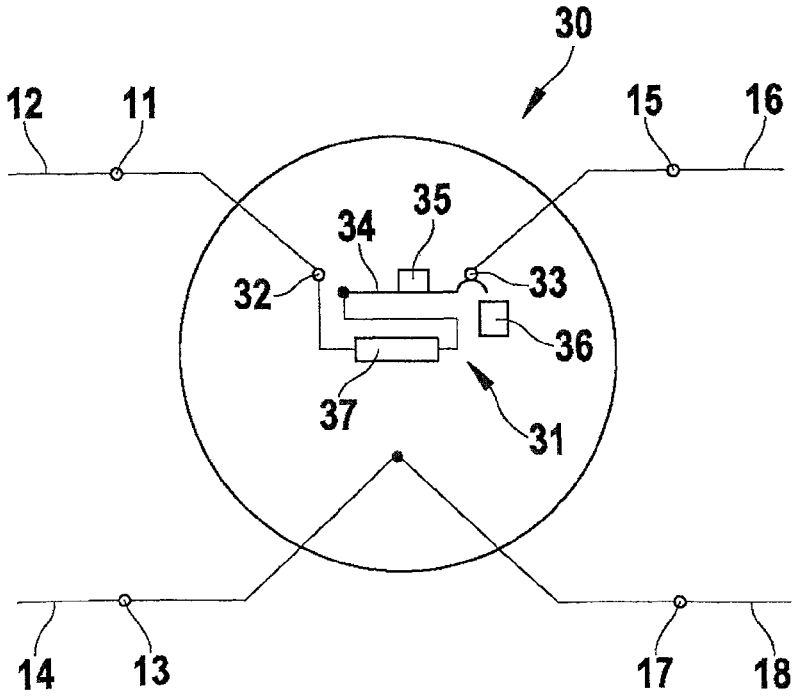
FIG. 3 shows a second embodiment of a power supply base according to the invention.

A second embodiment of a power supply base 30 is shown in FIG. 3. The external terminals 11, 13, 15, 17 can furnish the external terminals and connections to the power supply lines 12, 16 and return lines 14, 18 in the same way as in the first embodiment in FIG. 2. The switch element 31, conversely, has a different embodiment. The switch element 31 has a first terminal 32 that is connected to the incoming power supply line 12 and a second terminal 33 that is connected to the outgoing power supply line 16.

A spring contact 34 furnishes a switchable electrical connection between the first terminal 32 and the second terminal 33. In the same way as in the first embodiment, the spring contact 34 is initially arranged in such a way that it makes an electrical connection between the two terminals 32, 33. An actuating device 35 of the spring contact 34 causes the spring element to snap into the locking device 36 upon insertion of an alarm device. The actuating device 35 may be embodied in the same way as in the first embodiment. When the spring contact 34 is firmly held in the locking device 36, it interrupts the electrical connection between the first terminal 32 and the second terminal 33.

An electrical connection between the first contact 32 and the spring contact 34 is furnished by a resistor element 37.

The switch element may have an internal resistor with a resistance that is measurably greater than the resistance of wiring between the power supply bases. The resistance is preferably greater than 10 Ohms or 50 Ohms or 100 Ohms; expediently, it is in the range between 200 and 500 Ohms. Thus in the conducting state, the switch element 31 has a minimum resistance. Measuring the total resistance along a plurality of power supply bases, including interposed wiring, thus makes it possible to tell how many power supply bases are connected to one another. If the overall wiring is short, the resistance can be selected to be correspondingly low.

The resistor element 37 may be embodied by a resistor or by the use of suitable low-conducting materials for the spring contact 34.

After a plurality of power supply bases 30 have been installed and wired analogously to the power supply bases 10 in a series circuit or ring circuit, the total resistance of the series-connected power supply lines 12, 16 and power supply bases 30 is determined. If the resistance determined exceeds a predetermined threshold value, an alarm is issued that one or more of the power supply bases 30 have not been correctly connected. It is also checked whether the resistance determined is above a lower threshold value.

The lower threshold value is equivalent to the sum of all the resistances of the power supply bases 30 to be installed. If the resistance determined is less than the lower threshold value, then an alarm is issued that one or more of the power supply bases 30 are suspected to have been bridged by defective wiring. Such bridging can ensue for instance from connection of the external terminals 11, 15 or a connection of the incoming power supply line 12 to the external terminal 15. Checking whether all the power supply bases 30 are properly installed and wired is done before the alarm devices are inserted into the power supply bases 30.

The dimensioning of the resistance of the resistor element 37 is done taking into account the resistance of the maximum allowable length of the power supply line 12, 16. Expediently, the resistance of the resistor element 37 is greater than that of the power supply line 12, 16.

Figure 4:
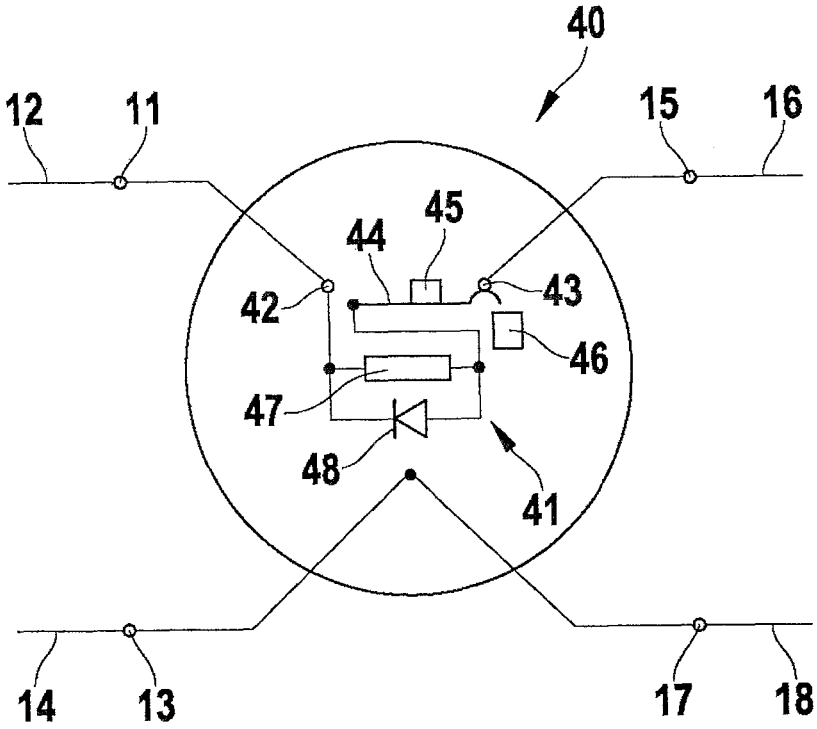
FIG. 4 shows a third embodiment of a power supply base according to the invention.

A third embodiment of the power supply base 40 is shown in FIG. 4. The power supply base 40 is largely equivalent to the second embodiment in FIG. 3. Between the first terminal 42 and the second terminal 43, a diode 48 is connected in the blocking direction. The blocking direction refers to the flow of current in the power supply line 12, 16, given proper installation of the power supply base 40. The other functional elements of the switch element 41 correspond to the switch element 31 in the second embodiment.

The diode 48 connected in the blocking direction can, as shown in FIG. 4, be connected parallel to the resistor element 47 and in series with the spring contact 44. It is furthermore also possible for the diode 48 to be connected parallel to the series circuit that comprises the resistor element 47 and the spring contact 44.

The diode 48 in the blocking direction serves to detect incorrectly polarized connection of the power supply base 40. If the connection is incorrectly polarized, the diode 48 is conducting, and the resistance between the terminals 42, 43 is considerably less than the resistance of the resistor element 47. The method described in conjunction with the second embodiment for detecting proper installation and wiring of power supply bases tells here that the total resistance of the series-connected power supply bases 40 and power supply lines 12, 16 is too low. Besides bridging of a power supply base 40, a connected power supply base 40 can be detected from a determined total resistance that is too low. Once again, the checking is done before the alarm devices are inserted.

Figure 5:
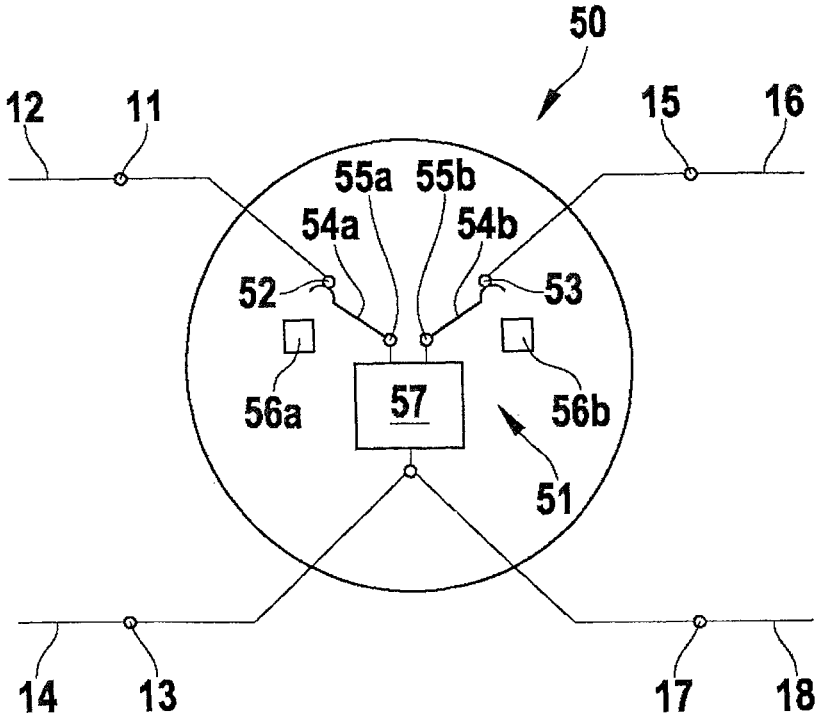
FIG. 5 shows a fourth embodiment of a power supply base according to the invention.

A fourth embodiment of the power supply base 50 is shown in FIG. 5. The external terminals 11, 13, 15, 17 are equivalent to those in the above embodiments; the same is true for the first terminal 52 and the second terminal 53, which are equivalent to the corresponding first and second terminals in the above embodiments. In this embodiment, the switch element 51 is formed by two spring contacts 54*a*, 54*b*, which conductively connect the first terminal 52 to the second terminal 53.

The two spring contacts 54*a*, 54*b* can be latched into locking retainers 56*a*, 56*b*. The latching is effected by inserting an alarm device into the power supply base 50 analogously to the above embodiments. A communications device 57 with two connecting terminals 55*a*, 55*b* is connected to the two spring contacts 54*a*, 54*b*. The communications device 57 is also connected to the return line 14, 18. In accordance with the mode of operation of the spring contacts 54*a*, 54*b*, the communications device 57 is initially active when a power supply base 50 has been freshly installed. It is permanently deactivated once an alarm device has been inserted into the power supply base 50 for the first time.

A warning system that is connected to the power supply base 50 via the power supply line 12 and the return line 14 communicates with the communications device 57. The communication can be limited to confirmation by the communications device 57 to the central warning system that the communications device 57 is present. The central warning system increments an internal counter each time existing communications devices 57 are confirmed. If the number of communications devices 57 counted matches the number of power supply bases 50 installed, then the proper installation of all the power supply bases 50 is confirmed. After that, the insertion of the alarm device into the power supply bases 50 can be begun.

The communications device 57 can have logic that goes beyond merely confirming its presence. The alarm device can additionally assign an unambiguous identification to each communications device. On the other hand, it is also possible for each of the communications devices 57 to already have a preconfigured, fixed, unambiguous, and preferably unique worldwide ID code.

Although the present invention has been described in conjunction with preferred embodiments, it is not limited to them.

In particular, instead of a spring contact 44, some other mechanically closing contact element may be employed.

It is also conceivable to use irreversibly penetrated contact elements. These contact elements are initially embodied such that they connect first and second terminals electrically conductively. When the alarm device is inserted, the contact element is mechanically destroyed, so that the two terminals are insulated from one another.

Instead of a mechanical switch element, an electrical switch element, for instance in the form of a transistor, may be employed. The transistor is dimensioned such that at typical test voltages, it conductively connects the first terminal and the second terminal 43. Typical test voltages are in the range of less than 10 volts. When the typical supply voltages, which are markedly more than 10 volts, for the alarm devices are applied, the transistors are burned through and they shift to an electrically insulating state.

In the above embodiments, the power supply base has only one switch element in the sole power supply line. The switch element may also be interposed into the return line or into further power supply lines.

It will be understood that each of the elements described above, or two or more together, may also find a useful application in other types of constructions differing from the type described above.

While the invention has been illustrated and described as embodied in a power supply base for an alarm device, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A power supply base for an alarm device, comprising at least one pair including a first terminal for an incoming power supply line and a second terminal for an outgoing power supply line; a switch element for an initial electrical connection of said first terminal to said second terminal of said at least one pair, said switch element having an actuating device for switching said switch element in response to an insertion of the alarm device into the power supply base wherein said switch element has an internal resistor with a resistance which is measurably greater than a resistance of wiring between power supply bases.

2. A power supply base as defined in claim 1, wherein said switch element has a locking device for keeping the switch element in a nonconducting state.

3. A power supply base as defined in claim 1, wherein said switch element has an initial resistance that is greater than a line resistance of the power supply lines.

4. A power supply base as defined in claim 1, wherein said switch element has an internal resistor; and further comprising a diode which is connected parallel in a blocking direction to said internal resistor of said switch element.

5. A power supply base as defined in claim 1; and further comprising a communication device for outputting an identification of the power supply base, said communication device being switchably coupled to said first terminal and to said second terminal by said switch element.

6. A power supply base as defined in claim 1, wherein said actuating device is a mechanical actuating device.

7. A method of setting up power supply bases for alarm devices, comprising the steps of furnishing at least one power supply base including at least one pair with a first terminal for an incoming power supply line and a second terminal for an outgoing power supply line and a switch element for an initial electrical connection of the first terminal to the second terminal of the at least one pair, which switch element has an actuating device for switching the switch element into the power supply base; connecting the at least one power supply base and one of the power supply lines in a topology selected from the group consisting of a serial topology and a ring topology; determining a total resistance of the topology without inserted alarm devices; and emitting a warning if the total resistance is greater than or equal to a resistance of the switch element in a nonconducting state.

8. A method for setting up power supply bases for alarm devices, comprising the steps of furnishing at least one power supply base including at least one pair with a first terminal for an incoming power supply line and a second terminal for an outgoing power supply line and a switch element for an initial electrical connection of the first terminal to the second terminal of the at least one pair, which switch element has an actuating device for switching the switch element into the power supply base; connecting the at least one power supply base and one of the power supply lines in a topology selected from the group consisting of a serial topology and a ring topology; determining a total resistance of the topology without inserted alarm devices; and outputting a warning if the total resistance corresponds at least to a resistance of the switch element in a nonconducting state, or if the total resistances is less than a sum of internal resistances of the switch elements of the power supply bases furnished.

* * * * *